United States Patent [19]

van den Brom

[11] 4,153,569

[45] May 8, 1979

[54] BUILT LIQUID DETERGENT

[75] Inventor: Guido C. van den Brom, Nieuw-Beijerland, Netherlands

[73] Assignee: Lever Brothers Company, New York

[21] Appl. No.: 839,535

[22] Filed: Oct. 5, 1977

[30] Foreign Application Priority Data

Oct. 11, 1976 [GB] United Kingdom ..... 42175/76

[51] Int. Cl.[2] ..... C11D 9/14

[52] U.S. Cl. ..... 252/109; 252/116; 252/121; 252/132; 252/173; 252/540; 252/DIG. 14

[58] Field of Search ..... 252/109, 116, 121, 132, 252/173, 540, DIG. 14

[56] References Cited

U.S. PATENT DOCUMENTS 4,082,684 4/1978 Keischer ..... 252/109

OTHER PUBLICATIONS

"Sodium Phosphates", Monsanto, 9/61, p. 19.

*Primary Examiner*—Mayer Weinblatt
*Attorney, Agent, or Firm*—Kenneth F. Dusyn

[57] ABSTRACT

A stable aqueous built liquid detergent composition is prepared comprising a potassium alkylbenzenesulphonate, a potassium fatty acid soap, a nonionic detergent material, a neutralized maleic anhydride copolymer, partially esterified with a nonionic detergent active, and sodium tripolyphosphate, wherein part of the sodium tripolyphosphate is replaced by tetrapotassium pyrophosphate.

5 Claims, No Drawings

BUILT LIQUID DETERGENT

CROSS-REFERENCE TO A RELATED APPLICATION:

The present invention relates to an improvement in aqueous built liquid detergent compositions of the type as described and claimed in the earlier co-pending patent application Ser. No. 680,953 of Kreischer, filed on April 28, 1976, now U.S. Pat. No. 4,082,684, assigned to the same assignee as the present application, and said earlier application is herein incorporated by reference thereto.

BACKGROUND OF THE INVENTION

In this earlier patent application aqueous built liquid detergent compositions comprising:

(a) from 3–12% by weight of a potassium alkylbenzenesulphonate with 10–18 carbon atoms in the alkyl chain, (b) from 2–8% by weight of a potassium soap of $C_8$–$C_{22}$ fatty acids or polymers thereof, (c) from 0.5–5% by weight of a nonionic detergent active material, which is an alkyleneoxide condensation product of an organic hydrophobic radical, (d) from 0.1–2% by weight of a neutralized copolymer of maleic anhydride with vinylmethylether, ethylene or styrene, partially esterified with a nonionic detergent active material, said copolymer having a specific viscosity of 0.1–4.5 (1 g in 100 ml methylethylketone at 25° C.), and (e) from 1–25% by weight of sodium tripolyphosphate are described and claimed.

A method of making such liquid detergent compositions comprises according to this earlier application:

1. dissolving part of the nonionic detergent active material in sufficient water while heating,
2. adding the copolymer to the resulting solution,
3. adding an excess of potassium hydroxide to the solution,
4. adding the alkylbenzene sulphonic acid and the fatty acid or polymer thereof to the resulting solution,
5. adding the balance of the nonionic detergent active material,
6. subsequently adding the sodium tripolyphosphate.

SUMMARY OF THE INVENTION

The present invention relates to an improvement in liquid detergent compositions of the above type, in that it has been found that part of the sodium tripolyphosphate may be replaced by tetrapotassium pyrophosphate, without impairing the phase-stability of such liquid detergent compositions.

DESCRIPTION OF THE PREFERRED EMBODIMENTS

The degree of replacement depends on the level of sodium tripolyphosphate; the lower this level, the more tetrapotassium pyrophosphate is used. The degree of replacement varies from 20–65%, i.e., 20–65% by weight of the sodium tripolyphosphate is replaced by tetrapotassium pyrophosphate, the total amount of sodium tripolyphosphate and tetrapotassium pyrophosphate being from 1–25% by weight of the final composition.

The balance of the liquid detergent composition, as well as the manner of making same, is identical with those described and claimed in the aforementioned earlier patent application. The tetrapotassium pyrophosphate is added at the same stage as the sodium tripolyphosphate.

EXAMPLE

In the manner as described in Example VI of the aforementioned earlier application, the following compositions were prepared:

| | 1 | 2 | 3 |
|---|---|---|---|
| | (in % by weight) | | |
| potassium dodecylbenzenesulphonate* | 6.5 | 6.5 | 6.5 |
| potassium salt of dimeric oleic acid* | 5.0 | 5.0 | 5.0 |
| $C_{13-15}$ primary alcohol, condensed with 11 moles of ethylene oxide | 2.5 | 2.5 | 2.5 |
| copolymer of maleic anhydride with vinylmethylether, having a specific viscosity of 0.1–0.5 | 0.5 | 0.5 | 0.5 |
| sodium carboxy methylcellulose | 0.6 | 0.6 | 0.6 |
| sodium silicate (100%) | 5.0 | 5.0 | 5.0 |
| sodium tripolyphosphate | — | — | 3.0 |
| tetrapotassium pyrophosphate | 7 | 5 | 4 |
| water | | balance | |

*calculated as acid

The viscosities of these products were 800, 1200 and 1000 cP, respectively, the pH was 12.5. These products were stable over 3 months' storage at room temperature.

I claim:

1. An aqueous built liquid detergent composition comprising:

(a) 3 to 12 weight percent of an anionic detergent consisting of a potassium alkylbenzenesulphonate, wherein the alkyl chain of said alkylbenzenesulphonate is a 10 to 18 carbon atom, branched or straight, alkyl chain;

(b) 2 to 8 weight percent of a soap consisting of a potassium salt of a fatty acid, derived from an 8 to 22 carbon atom, saturated or unsaturated, fatty acid or polymer thereof;

(c) 0.5 to 5 weight percent of a nonionic detergent consisting of an ethylene oxide or propylene oxide condensation product of an organic hydrophobic radical;

(d) 0.1 to 2 weight percent of a copolymer consisting of the copolymer of maleic anhydride with a compound selected from the group consisting of vinyl methyl ether, ethylene, and styrene, said copolymer having a specific viscosity of 0.1 to 4.5 measured as a one percent weight/volume solution of said copolymer in methylethylketone at 25° C.; and (e) 1 to 25 percent of a mixture of sodium tripolyphosphate and tetrapotassium pyrophosphate, said mixture comprising 20 to 65 percent by weight, calculated on said mixture, of tetrapotassium pyrophosphate; and wherein said copolymer has been partially esterified with said nonionic and subsequently neutralized, the ratio of the copolymer to nonionic to obtain the partially esterified copolymer ranging from 50:1 to 1:2.5.

2. The composition defined in claim 1 wherein component (d) is a copolymer of maleic anhydride with vinyl methyl ether and having a specific viscosity of 0.1 to 0.5

3. The composition defined in claim 1 wherein component (d) is a copolymer of maleic anhydride with ethylene.

4. The composition defined in claim 1 wherein component (d) is a copolymer of maleic anhydride with styrene.

5. The composition defined in claim 1, wherein the ratio of copolymer to nonionic to obtain the partially esterified copolymer is in the range of from 25:1 to 1:2.5.

* * * * *

UNITED STATES PATENT AND TRADEMARK OFFICE

CERTIFICATE OF CORRECTION

PATENT NO. : 4,153,569

DATED : May 8, 1979

INVENTOR(S) : Van den Brom

It is certified that error appears in the above-identified patent and that said Letters Patent are hereby corrected as shown below:

In the example contained in the specification, in particular lines 17 to 18 thereof, the line

| | | | |
|---|---|---|---|
| "sodium tripolyphosphate | -- | -- | 3.0" |

should read

| | | | |
|---|---|---|---|
| -- sodium tripolyphosphate | 11.0 | 16.0 | 18.0 |
| potassium tripolyphosphate | -- | -- | 3.0 -- |

Signed and Sealed this

First Day of January 1980

[SEAL]

Attest:

SIDNEY A. DIAMOND

Attesting Officer

Commissioner of Patents and Trademarks